US005174871A

United States Patent [19]

Russell

[11] Patent Number: 5,174,871

[45] Date of Patent: Dec. 29, 1992

[54] METHOD FOR PROVIDING CATHODIC PROTECTION OF UNDERGROUND STRUCTURES

[75] Inventor: Gordon I. Russell, Burlington, Canada

[73] Assignee: Interprovincial Corrosion Control Company Limited, Burlington, Canada

[21] Appl. No.: 722,430

[22] Filed: Jun. 27, 1991

[51] Int. Cl.[5] ..... C23F 13/00

[52] U.S. Cl. ..... 204/147; 204/148; 204/196; 204/197; 501/154

[58] Field of Search ..... 204/147, 148, 196, 197; 501/154

[56] References Cited

U.S. PATENT DOCUMENTS 2,480,087 8/1949 Robinson et al. ..... 204/197
3,001,919 9/1961 Petrocokino ..... 204/197
3,861,935 1/1975 Ohnemuller et al. ..... 501/154
4,435,264 3/1984 Lau ..... 204/197
4,623,435 11/1986 Nebgen et al. ..... 501/154

*Primary Examiner*—T. Tung
*Attorney, Agent, or Firm*—Arne I. Fors

[57] ABSTRACT

A method and composition for providing cathodic protection to underground steel structures is disclosed in which a composition comprising calcium hydroxide, calcium silicate and calcium nitrite is added to backfill for raising the backfill pH above 8 and an electrical current is applied to polarize the surface of the steel structure whereby the surface of the steel structure is maintained negative relative to the backfill. Magnesium hydroxide and aluminum hydroxide can be used as a substitute for at least a portion of the calcium hydroxide.

15 Claims, No Drawings

METHOD FOR PROVIDING CATHODIC PROTECTION OF UNDERGROUND STRUCTURES

BACKGROUND OF THE INVENTION

This invention relates to a method and composition for providing cathodic protection to metal structures and, more particularly, relates to a method and composition for providing cathodic protection to steel structures buried or partially buried in the ground.

Many underground steel structures such as pipelines, tanks and the like which are buried or partially buried in the ground, particularly large tanks and large-diameter pipelines and pipe risers, cannot be properly cathodically protected from corrosion. The buried surfaces of underground steel tanks, for example, are usually buried in sand and the like granular backfills and their aerated topside surfaces often require about 25 times the protective current density as their anaerobic bottoms. As a result of oxygen diffusion where protective coatings have failed or do not exist, it has often proven difficult or not feasible to prevent corrosion of bare and poorly coated tanks by applying cathodic protection with either galvanic and/or impressed current uniformly over entire steel surfaces.

It is a principal object of the present invention to cathodically protect the entire external surface of an uncoated or coated underground steel storage tank or the like buried steel structure.

SUMMARY OF THE INVENTION

It has been found that the chemical de-aeration of the backfill in which steel structures are buried by adding to said backfill by an electrically conductive composition containing calcium, magnesium and or aluminum compounds for producing an alkaline pH to precipitate in situ carbonate coatings or "concretions" on the metallic surface, with concurrent depletion of oxygen, facilitates uniform cathodic protection for underground steel structures.

The method of the invention for providing cathodic protection to a steel structure buried in backfill comprises, in its broad aspect, adding to said backfill calcium hydroxide in an amount effective to increase the pH of the backfill to above 8.0, and applying a protective current to create a polarized electrical potential between the surface of the steel structure and its backfill whereby the steel structure is maintained negative relative to the backfill. The method of the invention preferably includes adding a composition comprising a mixture of calcium hydroxide, calcium silicate and calcium nitrite.

The composition of the invention, in its broad aspect, for providing effective cathodic protection to underground steel structures comprises by weight, from about 75 to 90% calcium hydroxide, from about 3 to 20% calcium silicate, and an effective amount of calcium nitrite to remove oxygen in the mixed solution. Up to 50% by weight of the calcium hydroxide can be replaced by magnesium or aluminum hydroxide. The calcium nitrite is present in an effective amount of from 2% to a maximum 5% by weight for removal of oxygen.

DESCRIPTION OF THE PREFERRED EMBODIMENT

Typical soil backfills have a pH value ranging from about 4 to 8, usually in the range of about 5 to 7. These acidic or weakly alkaline backfills encourage creation of a corrosive environment.

A protective current requirement for cathodic protection is effective only when the entire surface is at a polarized potential and exposed to a highly alkaline protective layer. When this optimum state is secured, cathodic protection and its effectiveness is uniformly established over the surface to be protected.

It is believed that only when all oxygen is removed, or transformed into hydroxyl ion, that cathodic protection begins. It is for this reason that the current density required for cathodic protection at aerated upper surfaces of underground tanks, for example, is in the range of 25 to 35 times greater than for de-aerated bottomside surfaces. Therefore, the rate of oxygen diffusion to any portion of a buried steel surface must be minimized.

The voids in aerated granular backfill over the topside surfaces of buried steel structures are often well drained; thus voids are not filled with soil water electrolyte to readily conduct protective current. It is relatively easy to cathodically protect the lower surfaces of most underground tanks, because the soil electrolyte at that depth is less aerated or de-aerated. The upper surfaces, however, are atmospherically exposed in highly aerated granular backfill, and cannot be protected until their soil/metal interface are de-aerated.

This invention preferably makes use of a mixture of calcium hydroxide, calcium silicate, and calcium nitrite to deposit a calcareous concretion on the upper surface of the buried steel structure. Magnesium hydroxide can also be used because of the amphoteric properties of this compound and because it is more soluble than $Ca(OH)_2$. Magnesium hydroxide enhances the tightness of the precipitated formation of a calcium carbonate, magnesium carbonate, silicareous alkaline film deposit at the backfilled steel surface. In like manner, the amphoteric properties of aluminum hydroxide enhances the tightness of the precipitated film.

Although it will be understood that the description is not bound by hypothetical considerations, it is believed the presence of calcium hydroxide, or magnesium or aluminum hydroxide, raises the backfill pH to above 8 and, with the application of an electrical current from a galvanic or cathodic source, further raises the backfill pH to the range of 9–13. The calcium or magnesium cation, for example, combines with the $CO_2$ anion to form a precipitate of a thin adherent calcareous polarized film or coating of $CaCO_3$ and/or $MgCO_3$ on the steel structure surface. The calcium silicate is believed to assist in the tight adherent bonding of the film to the metallic surface and the calcium nitrite is believed to be an effective oxygen scavenger and to remove oxygen from the film and the backfill in proximity to the film.

The following range of constituents added with the backfill at the time of backfilling or added to the backfill after burial of a steel structure by pouring an aqueous slurry of the composition onto the backfill or into holes formed in the backfill is preferred:

| | |
|---|---|
| $Ca(OH)_2$ | 75–90% by weight |
| $Ca\ SiO_3$ | 3–20% by weight |
| $Ca\ NO2$ | 2–5% by weight |

-continued

| | |
|---|---|
| $Mg(OH)_2$ or $Al(OH)_3$ | up to 50% of the $Ca(OH)_2$ |

The composition can be applied by pouring or injecting a liquid mixture of calcium hydroxide with an effective amount of calcium nitrite at the site of, for example, a buried tank, separately from or with presoaked calcium silicate. Holes may be augured to insert nozzles through which the calcium silicate and the hydroxide/-nitrite mix are injected into the granular backfill (usually sand) directly over the tank. The chemical mixture percolates through the backfill until it reaches and covers the surface of the tank and spreads over and around the upper surface to form an enveloping layer of alkaline and electrically conductive chemicals. These chemicals react with $CO_2$ present in the air or ground water to precipitate at the metal surface only while an adequate protective current density is applied to increase the alkalinity of the surface layer at the soil/metal surface; the precipitate forming a continuous concrete shell or concretion over and around the upper surface of the steel tank.

Electrodes placed in the soil over and around the tank preferably are used to measure the polarized potential difference between the surface of the tank and its sand or soil environment. When the process of application is completed, the buried surface is entirely polarized.

For optimum cathodic protection, a protective current potential is applied and the potential difference is measured using a copper/copper sulfate reference to obtain a polarized potential between the tank surface and the soil. This value should be in the range −850 mV to −1150 mV, the tank being negative relative to its soil environment.

Potential differences are measured between the tank and its soil or sand environment to control the placement of the injection nozzles which serve as temporary anodes. The chemicals are injected until stable and uniform polarization potentials are obtained on the entire tank surface.

While protective current is applied, and the electrically conductive chemical mixture at the upper surfaces precipitates in the alkaline surface layer to form a protective calcareous deposit at the soil/steel interface, the current density reduces as more of the surface area becomes deaerated and the steel is covered with this protective deposit. When the process is complete, a uniform polarized potential is measured at all points over the backfilled surface of the metallic structure. The temporary nozzle "anodes" are used only until the "concretion" formed has stabilized and the protective current requirement has become minimal. When the entire surface of the steel structure is at a uniform polarized potential, original galvanic or impressed current anodes (usually placed near the bottom of the tank) now uniformly protect the upper as well as the lower surfaces and the polarized potential is permanently and uniformly maintained. When it is known that the soil/-steel interface is entirely polarized and therefore only exposed to a highly alkaline solution, the entire steel surface is substantially immune to corrosion.

The process of the invention will now be described with reference to the following non-limitative examples.

EXAMPLE 1

Steel specimens of 10" diameter pipe (API 5L) were buried to simulate typical, well-aerated topside surfaces of a tank with a wetted bottom. Compacted sand extended along one-half of each tank length and crushed stone screenings extended along the other half of each tank length. Appropriate carbon and reference zinc electrodes were positioned during backfilling and the potentials of these electrodes were monitored regularly by standard (CSE) surface electrodes.

A specimen identified as Specimen #1 was treated according to the method of the invention and a specimen identified as Specimen #2 provided a "control", this latter specimen not being regularly subjected to any form of chemical treatment except for additions of water.

Specimen #1 was treated with 1 L of Ca $NO_2$ solution, followed by 500 ml of $Ca(OH)_2$. This treatment resulted in a short term increase in the output of the original four graphite anodes from 33.3 mA to 1180 mA d.c. (4504 mA/sq.m. OR 419 MA/sq.ft.). This large increase in the resistivity of the soil by the ionic species produced was by the following reactions:

| | |
|---|---|
| $Ca(NO_2)_2$ (aq) | $Ca^{2-} + 2(NO_2)-$ |
| $Ca(OH)_2$ (aq) | $Ca^{2-} + 2(OH)-$ |

Although the solubility of $Ca(OH)_2$ is relatively small (1.85 g/L), the solubility of $CaNO2)_2$ is large (45.9 g/L) leading to a marked increase in the conductivity of the soil water. A more significant property of $CaNO2)_2$ is its action as an oxygen scavenger:

| | |
|---|---|
| $Ca(NO_2)_2 - O_2$(aq) | Ca(NO3) |

Accordingly the combined effect of the $Ca(OH)_2$—$CaNO2)_2$ chemical addition as a slurry was to lead to increased solution conductivity, scavenging of $O_2$ and a subsequent substantial increase in polarization properties.

By the time that the current output had stabilized at 4.5 mA the entire surface of the tank was uniformly polarized, with minimal depolarization observed during the period of current-interruption.

EXAMPLE 2

The soil over the specimens of the type described in Example 1 was initially treated with the following chemical solutions:

i) 500 ml of $Ca(OH)_2$ slurry;

ii) 200 ml of $CaNO2)_2$ solution; followed by iii) an additional 300 ml of $Ca(OH)_2$ slurry.

Two additional anodes were added over the top of Specimen #1 because of the decline in output of the four graphite anodes buried in the sand below the "tank".

With a d.c. rectifier operating at an applied voltage of 2.3 V, Specimen #1 and Specimen #2 ("Control") compared as shown in Table I.

TABLE 1

| | Specimen #1 | Specimen #2 |
|---|---|---|
| Current Transfer: (mA - d.c.) | 44.9 | 4.6 |
| Average Potential (bottom) (mV wrt. CSE) | −721 | −709 |

TABLE 1-continued

| | Specimen #1 | Specimen #2 |
|---|---|---|
| Average Shift from Native (bottom): (mV) | −338 | −298 |
| Average Potential (top): (mV wrt. CSE) | −840 | −671 |
| Average Shift from Native (top): (mV) | −459 | −259 |

A comparison of this data shows that the $Ca(NO_2)_2$ and $Ca(OH)_2$ chemical additions resulted in an overall negative shift of the surface of Specimen #1. Moreover, the top surface was not more polarized than the bottom due to the proximity of the top anodes and the high current density at this surface.

This specimen was subsequently transferred to a power source associated with a computerized data acquisition system. The total current output was reduced from 50 mA to 15.1 mA d.c. to obtain a more uniform level of polarization. The depolarization curves indicated that the $Ca(NO_2)_2$—$Ca(OH)_2$ solution treatment has led to a uniformly complete polarization at an accepted level from −850 mV (CSE) to −740 mV, (CSE) at the lowest output level.

It was observed that utilization of $Ca(OH)_2$ had a nominally beneficial effect of somewhat prolonged polarization but this polarization remained non-uniform and inconsistent over a large range of polarization potentials.

The subsequent utilization of a $Ca(OH)_2$—$CaSiO_3$ slurry led to more beneficial cathodic protection but the protection was still inadequate in degree and uniformity of electrochemical polarization.

The most effective chemical addition was obtained by a slurry of $Ca(OH)_2$—$Ca(NO_2)$—$CaSiO_3$; this led to extremely effective cathodic protection involving stable polarization potentials on the entire specimen surface at, for example, −840 mV (SCE) or even at −740 mV (CSE). This beneficial effect is believed attributed to the increased ionic conductivity of the soil water, the depletion of oxygen at the soil/metal interface by the scavenging activity of $Ca(NO)_2$ during the initial stages of polarization, and the extreme stability of the $Ca(OH)_2$—$Ca(SiO_3)$ adherent film formed during polarization at the metallic surface. A pH as high as 12 was observed at the soil/metal interface.

Addition of portland cement to the backfill of either type (granulated stone or sand) also resulted in a beneficial effect on cathodic protection by reducing the current requirement to a density <60 mA/m2. The backfill thus can comprise the composition of the invention with a mix of 2:1 to 4:1 of sand: portland cement.

Top-side surfaces of poorly coated and bare tanks submerged in backfill can be beneficially chemically treated with a $Ca(OH)_2$—$Ca(NO_2)_2$—$Ca(SiO_3)$ slurry during the establishment of cathodic protection in order to obtain optimal prevention of corrosion. Cathodic protection effectiveness by impressed current and/or sacrificial anodes in combination with the composition of the invention is substantially enhanced.

It will be understood, of course, that modifications can be made in the embodiment of the invention illustrated and described herein without departing from the scope and purview of the invention as defined by the appended claims.

I claim:

1. A composition for providing cathodic protection to underground steel structures comprising about 75 to 90% by weight calcium hydroxide, about 3 to 20% by weight calcium silicate, and an effective amount of calcium nitrite for removal of oxygen.

2. A composition as claimed in claim 1 in which said calcium nitrite comprises 2 to 5% by weight of the composition.

3. A composition as claimed in claim 1 in which said calcium hydroxide is present in an amount of about 90% by weight, said calcium silicate is present in an amount of about 8% by weight and said calcium nitrite is present in an amount of about 2% by weight.

4. A method of providing effective cathodic protection to a steel structure buried in the ground by uniformly polarizing the surface of said steel structure comprising backfilling said structure with an inert inorganic granular fill containing an effective amount of the composition of claim 1 as an electrically conductive continuous composition in contact with said steel structure.

5. A method of providing cathodic protection to an underground steel structure comprising adding to a backfill burying said structure an electrically conductive composition containing an effective amount of calcium hydroxide for raising the pH of the backfill to above 8 and precipitating a calcareous film on the structure, an effective amount of calcium silicate for adhering said film to the structure, and an effective amount of calcium nitrite for removing oxygen from said film.

6. A method as claimed in claim 5 in which an electrical current is applied to create a potential between the surface of the steel structure and the backfill whereby the steel structure is maintained negative relative to the backfill and the pH of the backfill is raised to above 9.

7. A method as claimed in claim 6 in which the electrical potential between the surface of the steel structure and the backfill is maintained in the range of −850 mV to −1150 mV.

8. A method as claimed in claim 6 in which the electric current is applied to raise the pH of the backfill to the range of 9–13.

9. A method as claimed in claim 6 in which said composition is mixed with sand and portland cement.

10. A method as claimed in claim 6 in which said calcium hydroxide is present in the composition in the amount of 75 to 90% by weight, said calcium silicate is present in the amount of 3 to 20% by weight, and the calcium nitrite is present in the amount of 2 to 5% by weight.

11. A method as claimed in claim 10 in which an electrical current is applied to create a potential between the surface of the steel structure and the backfill whereby the steel structure is maintained negative relative to the backfill and the pH of the backfill is raised to above 9.

12. A method as claimed in claim 5 in which, by weight of the composition, calcium hydroxide is present in an amount of about 37.5 to 90%, calcium silicate is present in an amount of about 3 to 20%, at least one of magnesium hydroxide or aluminum hydroxide is present in an amount by weight of up to 45%, and an effective amount of calcium nitrite is present.

13. A method as claimed in claim 12 in which an electrical current is applied to create a potential between the surface of the steel structure and the backfill whereby the steel structure is maintained negative relative to the backfill and the pH of the backfill is raised to above 9.

14. A composition for providing cathodic protection to underground steel structures comprising about 37.5 to 90% by weight calcium hydroxide, about 3 to 20% by weight calcium silicate, at least one of magnesium hydroxide or aluminum hydroxide present in an amount of up to 45%, and an effective amount of calcium nitrite for removal of oxygen.

15. A composition as claimed in claim 14 in which said calcium nitrite comprises 2 to 5% by weight of the composition.

* * * * *